US005670291A

United States Patent [19]

Ward et al.

[11] Patent Number: 5,670,291

[45] Date of Patent: Sep. 23, 1997

[54] PROCESS FOR FABRICATING AN ELECTROPHOTOGRAPHIC IMAGING MEMBER

[75] Inventors: Anthony T. Ward, Webster; Richard L. Schank, Pittsford; John S. Chambers, Rochester, all of N.Y.

[73] Assignee: Xerox Corporation, Stamford, Conn.

[21] Appl. No.: 722,759

[22] Filed: Sep. 27, 1996

[51] Int. Cl.[6] ..... G03G 5/047

[52] U.S. Cl. ..... 430/132; 430/59

[58] Field of Search ..... 430/59, 132

[56] References Cited

U.S. PATENT DOCUMENTS

| | | | |
|---|---|---|---|
| 4,871,634 | 10/1989 | Limburg et al. | 430/54 |
| 5,120,627 | 6/1992 | Nozomi et al. | 430/132 |
| 5,312,708 | 5/1994 | Terrell et al. | 430/59 |
| 5,342,719 | 8/1994 | Pai et al. | 430/59 |
| 5,436,099 | 7/1995 | Schank et al. | 430/132 |

*Primary Examiner*—Roland Martin

[57] ABSTRACT

A process for fabricating an electrophotographic imaging member including providing a substrate coated with at least one photoconductive layer, applying a coating composition to the photoconductive layer by dip coating to form a wet layer, the coating composition comprising finely divided amorphous silica particles, a dihydroxy amine charge transport material, an aryl charge transport material that is different from the dihydroxy amine charge transport material, a crosslinkable polyamide containing methoxy groups attached to amide nitrogen atoms and a crosslinking catalyst, at least one solvent for the hydroxy amine charge transport material, aryl charge transport material that is different from the dihydroxy amine charge transport material and the crosslinkable polyamide, and heating the wet layer to crosslink the polyamide and remove the solvent to form a dry layer in which the dihydroxy amine charge transport material and the aryl charge transport material are molecularly dispersed in a crosslinked polyamide matrix.

16 Claims, No Drawings

PROCESS FOR FABRICATING AN ELECTROPHOTOGRAPHIC IMAGING MEMBER

BACKGROUND OF THE INVENTION

The present invention relates in general to a a process for fabricating an electrophotographic imaging member, and more particularly to a process which includes the application of a thick coating by dip coating.

Electrophotographic imaging members, i.e. photoreceptors, typically include a photoconductive layer formed on an electrically conductive substrate. The photoconductive layer is a good insulator in the dark so that electric charges are retained on its surface. Upon exposure to light, the charge is dissipated.

An electrostatic latent image is formed on the photoreceptor by first uniformly depositing an electric charge over the surface of the photoconductive layer by one of any suitable means well known in the art. The photoconductive layer functions as a charge storage capacitor with charge on its free surface and an equal charge of opposite polarity (the counter charge) on the conductive substrate. A light image is then projected onto the photoconductive layer. On those portions of the photoconductive layer that are exposed to light, the electric charge is conducted through the layer reducing the surface charge. The portions of the surface of the photoconductive not exposed to light retain their surface charge. The quantity of electric charge at any particular area of the photoconductive surface is inversely related to the illumination incident thereon, thus forming an electrostatic latent image. After development of the latent image with toner particles to form a toner image, the toner image is usually transferred to a receiving member such as paper. Transfer is effected by various means such as by electrostatic transfer during which an electrostatic charge is applied to the back side of the receiving member while the front side of the member is in contact with the toner image.

The photodischarge of the photoconductive layer requires that the layer photogenerate conductive charge and transport this charge through the layer thereby neutralizing the charge on the surface. Two types of photoreceptor structures have been employed: multilayer structures wherein separate layers perform the functions of charge generation and charge transport, respectively, and single layer photoconductors which perform both functions. These layers are formed on an electrically conductive substrate and may include an optional charge blocking and an adhesive layer between the conductive layer and the photoconducting layer or layers. Additionally, the substrate may comprise a non-conducting mechanical support with a conductive surface. Other layers for providing special functions such as incoherent reflection of laser light, dot patterns for pictorial imaging or subbing layers to provide chemical sealing and/or a smooth coating surface may optionally be employed.

One common type of photoreceptor is a multilayered device that comprises a conductive layer, a blocking layer, an adhesive layer, a charge generating layer, and a charge transport layer. The charge transport layer can contain an active aromatic diamine molecule, which enables charge transport, dissolved or molecularly dispersed in a film forming binder. This type of charge transport layer is described, for example in U.S. Pat. No. 4,265,990. Other charge transport molecules disclosed in the prior art include a variety of electron donor, aromatic amines, oxadiazoles, oxazoles, hydrazones and stilbenes for hole transport and electron acceptor molecules for electron transport. Another type of charge transport layer has been developed which utilizes a charge transporting polymer wherein the charge transporting moiety is incorporated in the polymer as a group pendant from the backbone of the polymer backbone or as a moiety in the backbone of the polymer. These types of charge transport polymers include materials such as poly(N-vinylcarbazole), polysilylenes, and others including those described, for example, in U.S. Pat. Nos. 4,618,551, 4,806,443, 4,806,444, 4,818,650, 4,935,487, and 4,956,440. The disclosures of these patents are incorporated herein in their entirety.

Charge generator layers comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, magnesium phthalocyanine and metal-free phthalocyanine. The phthalocyanines exist in many crystal forms which have a strong influence on photogeneration.

One of the design criteria for the selection of the photosensitive pigment for a charge generator layer and the charge transporting molecule for a transport layer is that, when light photons photogenerate holes in the pigment, the holes be efficiently injected into the charge transporting molecule in the transport layer. More specifically, the injection efficiency from the pigment to the transport layer should be high. A second design criterion is that the injected holes be transported across the charge transport layer in a short time; shorter than the time duration between the exposure and development stations in an imaging device. The transit time across the transport layer is determined by the charge carrier mobility in the transport layer. The charge carrier mobility is the velocity per unit field and has dimensions of $cm^2$/volt sec. The charge carrier mobility is a function of the structure of the charge transporting molecule, the concentration of the charge transporting molecule in the transport layer and the electrically "inactive" binder polymer in which the charge transport molecule is dispersed.

Reprographic machines often utilize multilayered organic photoconductors and can also employ corotrons, scorotrons or bias charging rolls to charge the photoconductors prior to imagewise exposure. Further, corotrons, scorotrons or bias transfer rolls may be utilized to transfer toner images from a photoreceptor to a receiving member. It has been found that as the speed and number of imaging of copiers, duplicators and printers are increased, bias transfer rolls and bias charge rolls can cause serious wear problems to the photoreceptors. Bias transfer rolls and bias charge rolls are known in the art and bias transfer rolls are described, for example, in U.S. Pat. No. 5,420,677, U.S. Pat. No. 5,321,476 and U.S. Pat. No. 5,303,014. The entire disclosures of these patents are incorporated herein by reference. As a consequence of the abrasive action of the bias transfer rolls and bias charge rolls charge rollers, the operating lifetime of conventional photoreceptors is severely reduced. The precise nature of the electrical/abrasive wearing away of the charge transport layer thickness is unknown, but it is theorized that some degradative process involving charge scission of the binder occurs, or in the case of arylamine hole transporting polymers, the reduction in chain lengths causes the polymers to lose their inherent strength.

As described above, one type of multilayered photoreceptor that has been employed as a belt in electrophotographic imaging systems comprises a substrate, a conductive layer, a charge blocking layer a charge generating layer, and a charge transport layer. The charge transport layer often comprises an activating small molecule dispersed or dissolved in an polymeric film forming binder. Generally, the polymeric film forming binder in the transport layer is electrically inactive by itself and becomes electrically active when it contains the activating molecule. The expression "electrically active" means that the material is capable of supporting the injection of photogenerated charge carriers from the material in the charge generating layer and is capable of allowing the transport of these charge carriers through the electrically active layer in order to discharge a surface charge on the active layer. The multilayered type of photoreceptor may also comprise additional layers such as an overcoating layer. Although excellent toner images may be obtained with multilayered photoreceptors that are developed with dry developer powder (toner), it has been found that these same photoreceptors can become unstable when employed with liquid development systems. These photoreceptors suffer from cracking, crazing, crystallization of active compounds, phase separation of activating compounds and extraction of activating compounds caused by contact with the organic carrier fluid, isoparaffinic hydrocarbons e.g. Isopar, commonly employed in liquid developer inks which, in turn, markedly degrade the mechanical integrity and electrical properties of the photoreceptor. More specifically, the organic carrier fluid of a liquid developer tends to leach out activating small molecules, such as the arylamine containing compounds typically used in the charge transport layers. Representative of this class of materials are: N,N'-diphenyl-N,N'-bis(3-methylphenyl)-[1,1'-biphenyl]-4,4'-diamine; bis-(4-diethylamino-2-methylphenyl)-phenylmethane; 2,5-bis-(4'-dimethylaminophenyl)-1,3,4,-oxadiazole; 1-phenyl-3-(4'-diethylaminostyryl)-5-(4"-diethylaminophenyl)-pyrazoline; 1,1-bis-(4-(di-N,N'-p-methylphenyl)-aminophenyl)-cyclohexane; 4-diethylaminobenzaldehyde-1,1-diphenylhydrazone; 1,1-diphenyl-2(p-N,N-diphenyl amino phenyl)-ethylene; N-ethylcarbazole-3-carboxaldehyde-1-methyl-1-phenylhydrazone. The leaching process results in crystallization of the activating small molecules, such as the aforementioned arylamine compounds, onto the photoreceptor surface and subsequent migration of arylamines into the liquid developer ink. In addition, the ink vehicle, typically a $C_{10}$–$C_{14}$ branches hydrocarbon, induces the formation of cracks and crazes in the photoreceptor surface. These effects lead to copy defects and shortened photoreceptor life. The degradation of the photoreceptor manifests itself as increased background and other printing defects prior to complete physical photoreceptor failure. The leaching out of the activating small molecule also increases the susceptibility of the transport layer to solvent/stress cracking. Some carrier fluids may also promote phase separation of the activating small molecules, such as arylamine compounds, in the transport layers, particularly when high concentrations of the arylamine compounds are present in the transport layer binder. Phase separation of activating small molecules also adversely alters the electrical and mechanical properties of a photoreceptor. Similarly, single layer photoreceptors having a single active layer comprising photoconductive particles dispersed in a charge transport film forming binder are also vulnerable to the same degradation problems encountered by the previously described multilayered type of photoreceptor when exposed to liquid developers. Sufficient degradation of these photoreceptors by liquid developers can occur in less than two hours as indicated by leaching of the small molecule and cracking of the matrix polymer film. Continued exposure for several days severely damages the photoreceptor. Thus, in advanced imaging systems utilizing multilayered photoreceptors exposed to liquid development systems, cracking and crazing have been encountered in critical charge transport layers during image cycling. Cracks developing in charge transport layers during cycling can be manifested as print-out defects adversely affecting copy quality. Furthermore, cracks in the photoreceptor pick up toner particles which cannot be removed in the cleaning step and may be transferred to the background in subsequent prints. In addition, crack areas are subject to delamination when contacted with blade cleaning devices thus limiting the options in electrophotographic product design.

Photoreceptors have been developed which comprise charge transfer complexes prepared with polymeric molecules. For example, charge transfer complexes formed with polyvinyl carbazole are disclosed in U.S. Pat. No. 4,047,948, U.S. Pat. No. 4,346,158 and U.S. Pat. No. 4,388,392. Photoreceptors utilizing polyvinyl carbazole layers, as compared with current photoreceptor requirements, exhibit relatively poor xerographic performance in both electrical and mechanical properties. Thus, in advanced imaging systems utilizing multilayered photoreceptors exposed to liquid development systems, cracking and crazing have been encountered in critical charge transport layers during image cycling. Still other arylamine charge transporting polymers such as those disclosed in U.S. Pat. No. 4,806,444, U.S. Pat. No. 4,806,443, U.S. Pat. No. 4,935,487, and U.S. Pat. No. 5,030,532 are vulnerable to reduced life because of the highly abrasive conditions presented by imaging systems utilizing bias transfer rolls and/or bias charge rollers.

Protective overcoatings can be somewhat helpful against abrasion. However, most protective overcoatings also fail early when subjected to the highly abrasive conditions presented by imaging systems utilizing bias transfer rolls and/or bias charge rollers. Moreover, many overcoatings tend to accumulate residual charge during cycling. This can cause a condition known as cycle-up in which the residual potential continues to increase with multi-cycle operation. This can give rise to increased densities in the background areas of the final images.

A conventional technique for coating drum type photoreceptors is by dip coating and generally involves the direct immersion of a substrate into the coating liquid and thereafter withdrawal carrying a liquid coating layer on the outer surface thereof. This layer is dried to remove solvents from the layer. The dip coating and drying operations may be repeated to form other different coating layers on the drum. Thus, for example, an uncoated drum may be subjected to multiple dipping and drying operations to from a charge blocking layer, a charge generating layer, a charge transport layer and, optionally, an overcoating layer. Dip coating processes are well known in the art and are described, for example, in U.S. Pat. No. 5,244,697 and U.S. Pat. No. 5,422,144, the entire disclosures thereof being incorporated herein. The application of polyamide as an undercoat or subbing layer in drum electrophotographic devices by dip coating can be accomplished for relatively thin layers, usually on the order of 1.5 micrometers thick. This thickness provide complete coverage of surface asperities of a conductive substrate whose surface has been deliberately roughened in order to suppress undesirable optical interference effects which can occur when an electrophotographic drum which has been coated on a smooth, reflective substrate, is used in a laser printer. Polyamide layers thicker than 1.5 microns can be applied in a single pass, but require application by "lathe coating" or Tsukiage coating, not by conventional dip coating. Lathe coating involves the use of an applicator, such as a sponge to apply coating material onto a cylindrical substrate while the substrate is rotated on a lathe. Tsukiage coating pertains to a technique in which a drum is coated by moving it upwardly through a seal at the bottom of a small coating bath container. Formation of a coating of polyamide layers by conventional single pass dip coating techniques to form coating thicknesses greater than 1.5 micrometers is made difficult by the vulnerability of the coating solution to inhomogeneity (gel formation) at the higher solids concentrations necessary for thicker dip coatings. Gel formation terminates usefulness of a coating for forming precision coatings by dip coating. Generally, the maximum polyamide coating thickness that can be achieved by single pass dip coating is about 2 micrometers. However, achievement of this thickness requires discarding of the coating bath after about one week because of gel formation. Multiple pass dip coating can form thicker coatings, but require a drying step between each coating pass thereby requiring more complex coating equipment and increased fabrication time. Also, redipping a dried polyamide coating into a coating solution containing a solvent which dissolves polyamide material can complicate the formation of thick uniform polyamide layers. Moreover, polyamide undercoat or subbing layers should not be unduly thick because increased thicknesses can cause residual charge buildup during repeated image cycling.

INFORMATION DISCLOSURE STATEMENT

U.S. Pat. No. 4,871,634 to W. Limburg et al., issued Oct. 3, 1989—A hydroxy arylamine compound, represented by a specific formula, is disclosed as employable in photoreceptors.

U.S. Pat. No. 5,096,795 to R. Yu, issued May 17, 1992—An electrophotographic imaging device is disclosed containing material for exposed layers and members having particles homogeneously dispersed therein. The particles provide coefficient of surface contact friction reduction, increased wear resistance, durability against tensile cracking, and improved adhesion of the layers without adversely affecting the optical and electrical properties of the imaging member. These particles can include microcrystalline silica.

CROSS REFERENCE TO RELATED APPLICATIONS

This application is related to the following U.S. patent applications:

U.S. patent application Ser. No. 721,817 pending, filed concurrently herewith in the names of R. Schank et al., entitled "COMPOSITIONS AND PHOTORECEPTOR OVERCOATINGS CONTAINING A DIHYDROXY ARYLAMINE AND A CROSSLINKED POLYAMIDE"—An electrophotographic imaging member is disclosed including including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. patent application Ser. No. 721,811 pending, filed concurrently herewith in the names of R. Schank et al., entitled "OVERCOATED ELECTROPHOTOGRAPHIC IMAGING MEMBER WITH RESILIENT CHARGE TRANSPORT LAYER"—A flexible electrophotographic imaging member is disclosed free of an anticurl backing layer, the imaging member including a supporting substrate uncoated on one side and coated on the opposite side with at least a charge generating layer, a charge transport layer and an overcoating layer, the transport layer including a resilient hole transporting arylamine siloxane polymer and the overcoating including a polyamide crosslinked with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. patent application Ser. No. 722,347 pending, filed concurrently herewith in the names of Yutt et al., entitled "HIGH SPEED ELECTROPHOTOGRAPHIC IMAGING MEMBER"—An electrophotographic imaging member is disclosed including a charge generating layer, a charge transport layer and an overcoating layer, the transport layer including a charge transporting aromatic diamine molecule in a polystyrene matrix and the overcoating layer including a hole transpoRing hydroxy arylamine compound having at least two hydroxy functional groups and a polyamide film forming binder capable of forming hydrogen bonds with the hydroxy functional groups of the hydroxy arylamine compound. This imaging member is utilized in an imaging process.

Thus, there is a continuing need for photoreceptors having improved resistance to abrasive cycling conditions and increased densities in the background areas of the final images, and cyclic instabilities.

SUMMARY OF THE INVENTION

It is, therefore, an object of the present invention to provide an improved electrophotographic imaging member fabrication process which overcomes the above-noted deficiencies.

It is yet another object of the present invention to provide an improved electrophotographic imaging member fabrication process capable of longer cycling life under abrasive imaging conditions.

It is still another object of the present invention to provide an improved electrophotographic imaging member fabrication process that forms thick polyamide layers.

It is another object of the present invention to provide an improved electrophotographic imaging member fabrication process that forms imaging members which resist cracking in a liquid development environment.

It is still another object of the present invention to provide an improved electrophotographic imaging member fabrication process that utilizes stable polyamide coating mixtures.

It is another object of the present invention to provide an improved electrophotographic imaging member fabrication process that forms imaging members which resist degradation by corona species.

It is yet another object of the present invention to provide an improved electrophotographic imaging member fabrication process which forms a thicker coating during a single coating pass.

The foregoing objects and others are accomplished in accordance with this invention by providing a process for fabricating an electrophotographic imaging member comprising providing a substrate coated with at least one photoconductive layer, applying a coating composition to the photoconductive layer by dip coating to form a wet layer, the coating composition comprising finely divided amorphous silica particles, a dihydroxy amine charge transport material, an aryl charge transport material that is different from the dihydroxy amine charge transport material, a crosslinkable polyamide containing methoxy groups attached to amide nitrogen atoms, a crosslinking catalyst, and at least one solvent for the hydroxy amine charge transport material, aryl charge transport material and the crosslinkable polyamide, and heating the wet layer to crosslink the polyamide and remove the solvent to form a dry layer in which the dihydroxy amine charge transport material and the aryl charge transport material that is different from the dihydroxy amine charge transport material are molecularly dispersed in a crosslinked polyamide matrix.

Electrophotographic imaging members are well known in the art. Electrophotographic imaging members may be prepared by any suitable technique. Typically, a rigid substrate is provided with an electrically conductive surface. A charge generating layer is then applied to the electrically conductive surface. A charge blocking layer may optionally be applied to the electrically conductive surface prior to the application of a charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties for dip coating. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be of any suitable configuration and dimensions. Preferably, the substrate is cylindrical, rigid and hollow. It can even be in the form of an endless flexible belt, a web, sheet or the like if sufficiently stiff or properly supported for dip coating.

The thickness of the substrate layer depends on numerous factors, including strength desired and economical considerations. Thus, for a drum, this layer may be of substantial thickness of, for example, up to many centimeters or of a minimum thickness of less than a millimeter.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. The conductive coating should also be continuous. The conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-di-amine.

Any suitable electrically inert polymeric binder may used to disperse the electrically active molecule in the charge transport layer is a poly(4,4'-isopropylidene-diphenylene) carbonate (also referred to as bisphenol-A-polycarbonate), poly(4,4'-isoprpylidene-diphenylene)carbonate, poly(4,4'-diphenyl-1/1'-cyclohexane carbonate), and the like. Other typical inactive resin binders include polyester, polyarylate, polyacrylate, polyether, polysulfone, and the like. Molecular weights can vary, for example, from about 20,000 to about 150,000.

Instead of a small molecule charge transporting compound dissolved or molecularly dispersed in an electrically inert polymeric binder, the charge transport layer may comprise any suitable charge transporting polymer. A typical charge transporting polymers is one obtained from the condensation of N,N'-diphenyl-N,N'-bis (3-hydroxy phenyl) -[1,1'-biphenyl]-4,4'-diamine and diethylene glycol bischloroformate such as disclosed in U.S. Pat. No. 4,806,443 and U.S. Pat. No. 5,028,687, the entire disclosures of these patent being incorporated herein by reference. Another typical charge transporting polymer is poly(N,N'-bis-(3-oxyphenyl)-N,N'-diphenyl [1,1'-biphenyl]-4,4'-diaminesebacoyl) polyethercarbonate obtained from the condensation of N,N'-diphenyl-N,N'-bis (3-hydroxy phenyl)-[1,1'-biphenyl]-4,4'-diamine and sebacoyl chloride.

Any suitable and conventional technique may be utilized to mix and thereafter apply conventional charge transport layer coating mixtures to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. If the transport layer to be applied is the coating composition of this invention instead of a conventional charge transport composition, the coating is only applied by a dip coating technique.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. In other words, the charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

The overcoat or charge transport layer of this invention comprises a mixture formed from finely divided silica particles, a dihydroxy amine charge transport material, an aryl charge transport material that is different from the dihydroxy amine charge transport material, a crosslinkable polyamide containing methoxy groups attached to amide nitrogen atoms. After crosslinking of the polyamide, this layer contains the the dihydroxy arylamine and aryl charge transport material that is different from the dihydroxy amine charge transport material dissolved or molecularly dispersed in a crosslinked polyamide matrix and the silica particles dispersed in the crosslinked polyamide matrix.

Any suitable hole insulating film forming alcohol soluble polyamide polymer having methoxy methyl groups attached to the nitrogen atoms of amide groups in the polymer backbone prior to crosslinking may be employed in the overcoating of this invention. A preferred alcohol soluble polyamide polymer having methoxy methyl groups attached to the nitrogen atoms of amide groups in the polymer backbone prior to crosslinking is selected from the group consisting of materials represented by the following formulae I and II:

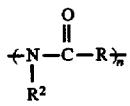

I wherein:

n is a positive integer,

R is independently selected from the group consisting of alkylene, arylene or alkarylene units, between 1 and 99 percent of the $R^2$ sites are —H, and the remainder of the $R^2$ sites are $—CH_2—O—CH_3$ and

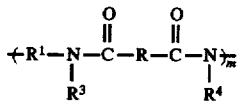

II wherein:

m is a positive integer, $R_1$ and R are independently selected from the group consisting of alkylene, arylene or alkarylene units, between 1 and 99 percent of the $R^3$ and $R^4$ sites are —H, and the remainder of the $R^3$ and $R^4$ sites are $—CH_2—O—CH_3$.

Between about 1 percent and about 50 mole percent of the total number of repeat units of the nylon polymer should contain methoxy methyl groups attached to the nitrogen atoms of amide groups. These polyamides should form solid films if dried prior to crosslinking. The polyamide should also be soluble, prior to crosslinking, in the alcohol solvents employed. Typical alcohols in which the polyamide is soluble include, for example, butanol, ethanol, methanol, and the like. Typical alcohol soluble polyamide polymers having methoxy methyl groups attached to the nitrogen atoms of amide groups in the polymer backbone prior to crosslinking include, for example, hole insulating alcohol soluble polyamide film forming polymers include, for example, Luckamide 5003 from Dai Nippon Ink, Nylon 8 with methylmethoxy pendant groups, CM4000 from Toray Industries, Ltd. and CM8000 from Toray Industries, Ltd. and other N-methoxymethylated polyamides, such as those prepared according to the method described in Sorenson and Campbell "Preparative Methods of Polymer Chemistry" second edition, pg 76, John Wiley & Sons Inc. 1968, and the like and mixtures thereof. These polyamides can be alcohol soluble, for example, with polar functional groups, such as methoxy, ethoxy and hydroxy groups, pendant from the polymer backbone. It should be noted that polyamides, such as Elvamides from DuPont de Nemours & Co., do not contain methoxy methyl groups attached to the nitrogen atoms of amide groups in the polymer backbone. The overcoating layer of this invention preferably comprises between about 50 percent by weight and about 98 percent by weight of the crosslinked film forming crosslinkable alcohol soluble polyamide polymer having methoxy methyl groups attached to the nitrogen atoms of amide groups in the polymer backbone, based on the total weight of the overcoating layer after crosslinking and drying. These film forming polyamides are also soluble in a solvent to facilitate application by conventional coating techniques. Typical solvents include, for example, butanol, methanol, butyl acetate, ethanol, cyclohexanone, tetrahydrofuran, methyl ethyl ketone, and the like and mixtures thereof. Crosslinking is accomplished by heating in the presence of a catalyst. Any suitable catalyst may be employed. Typical catalysts include, for example, oxalic acid, p-toluenesulfonic acid, methanesulfonic acid, and the like and mixtures thereof. Catalysts that transform into a gaseous product during the crosslinking reaction are preferred because they escape the coating mixture and leave no residue that might adversely affect the electrical properties of the final overcoating. A typical gas forming catalyst is, for example, oxalic acid. The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking is preferred for flexible photoreceptors having, for example, web or belt configurations. The degree of crosslinking can be controlled by the relative amount of catalyst employed. The amount of catalyst to achieve a desired degree of crosslinking will vary depending upon the specific polyamide, catalyst, temperature and time used for the reaction. A typical crosslinking temperature used for Luckamide with oxalic acid as a catalyst is about 125° C. for 30 minutes. After crosslinking, the overcoating should be substantially insoluble in the solvent in which it was soluble prior to crosslinking. Thus, no overcoating material will be removed when rubbed with a cloth soaked in the solvent. Crosslinking results in the development of a three dimensional network which restrains the dihydroxy arylamine molecule as a fish is caught in a gill net. Prolonged attempts to extract the highly fluorescent dihydroxy arylamine hole transport molecule from the crosslinked overcoat, using long exposure to branched hydrocarbon solvents, revealed that the transport molecule is completely immobilized. Thus, when UV light is used to examine the extractant or the applicator pad no fluorescence is observed. The molecule is also locked into the overcoat by hydrogen bonding to amide sites on the polyamide.

The overcoating of this invention also includes a dihydroxy arylamine. Preferably, the dihydroxy arylamine is represented by the following formula:

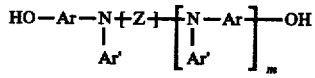

wherein:

m is 0 or 1,

Z is selected from the group consisting of:

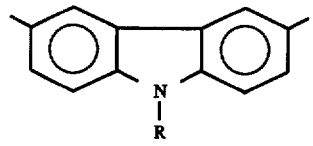

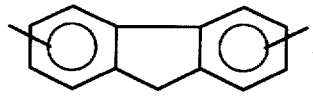

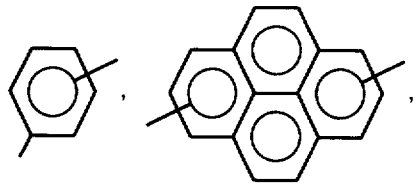

and

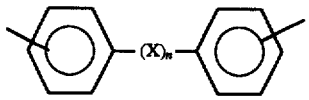

n is 0 or 1,

Ar is selected from the group consisting of:

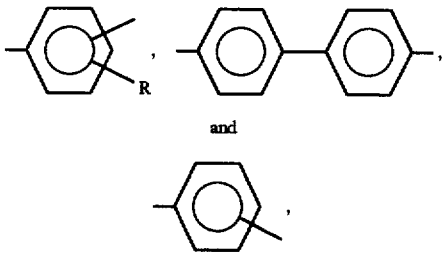

R is selected from the group consisting of $—CH_3$, $—C_2H_5$, $—C_3H_7$, and $—C_4H_9$.

Ar' is selected from the group consisting of:

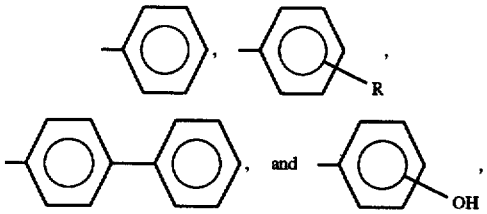

X is selected from the group consisting of:

s is 0, 1 or 2.

This hydroxy arylamine compound is described in detail in U.S. Pat. No. 4,871,634, the entire disclosure thereof being incorporated herein by reference.

Generally, the hydroxy arylamine compounds are prepared, for example, by hydrolyzing an dialkoxy arylamine. A typical process for preparing alkoxy arylamines is disclosed in Example I of U.S. Pat. No. 4,588,666 to Stolka et al, the entire disclosure of this patent being incorporated herein by reference. The dihydroxy arylamine compound should be free of any direct conjugation between the —OH groups and the $-CH_2-$, $-C(CH_3)_2-$, $-O-$, $-S-$,

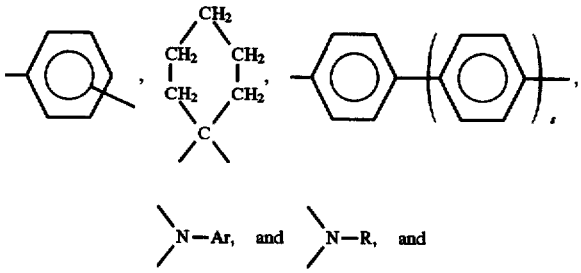

nearest nitrogen atom through one or more aromatic rings because layers containing compounds having such direct conjugation fail to support transport of electrical charges.

Typical hydroxy arylamine compounds of this invention include, for example:

N,N'-diphenyl-N,N'-bis(3-hydroxyphenyl)-[1,1'-biphenyl]-4,4'-diamine;

N,N,N',N',-tetra(3-hydroxyphenyl)-[1,1'-biphenyl]-4,4'-diamine;

N,N-di(3-hydroxyphenyl)-m-toluidine;

1,1-bis-[4-(di-N,N-m-hydroxpyphenyl)-aminophenyl]-cyclohexane; 1,1-bis[4-(N-m-hydroxyphenyl)-4-(N-phenyl)-aminophenyl]-cyclohexane;

Bis-(N-(3-hydroxyphenyl)-N-phenyl-4-aminophenyl)-methane;

Bis[(N-(3-hydroxyphenyl)-N-phenyl)-4-aminophenyl]-isopropylidene;

N,N'-diphenyl-N,N'-bis(3-hydroxyphenyl)-[1,1':4',1"-terphenyl]-4,4"-diamine;

9-ethyl-3.6-bis[N-phenyl-N-3(3-hydroxyphenyl)-amino]-carbazole;

2,7-bis[N,N-di(3-hydroxyphenyl)-amino]-fluorene;

1,6-bis[N,N-di(3-hydroxyphenyl)-amino]-pyrene;

1,4-bis[N-phenyl-N-(3-hydroxyphenyl)]-phenylenediamine.

N,N'-diphenyl-N-N'-bis(4-hydroxy phenyl)[1,1'-biphenyl]-4,4'-diamine

N,N,N',N',-tetra(4-hydroxyphenyl)-[1,1'-biphenyl]-4,4'-diamine;

N,N-di(4-hydroxyphenyl)-m-toluidine;

1,1-bis-[4-(di-N,N-p-hydroxpyphenyl)-aminophenyl]-cyclohexane;

1,1-bis[4-(N-o-hydroxyphenyl)-4-(N-phenyl)-aminophenyl]-cyclohexane;

Bis-(N-(4-hydroxyphenyl)-N-phenyl-4-aminophenyl)-methane;

Bis[(N-(4-hydroxyphenyl)-N-phenyl)-4-aminophenyl]-isopropylidene;

Bis-N,N-[(4'-hydroxy-4-(1,1'-biphenyl)]-aniline

Bis-N,N-[(2'-hydroxy-4-(1,1'-biphenyl)]-aniline

The concentration of the hydroxy arylamine in the overcoat can be between about 2 percent and about 50 percent by weight based on the total weight of the dried overcoat. Preferably, the concentration of the hydroxy arylamine in the overcoat layer is between about 10 percent by weight and about 50 percent by weight based on the total weight of the dried overcoat. When less than about 10 percent by weight of hydroxy arylamine is present in the overcoat, a residual voltage may develop with cycling resulting in background problems. If the amount of hydroxy arylamine in the overcoat exceeds about 50 percent by weight based on the total weight of the overcoating layer, crystallization may occur resulting resulting in residual cycle-up. In addition, mechanical properties, abrasive wear properties are negatively impacted.

The overcoating layer or charge transport layer dip coating composition of this invention also comprises an aryl charge transporting small molecule that is different from the dihydroxy amine charge transport material described above. This additional charge transport material should also be dissolved or molecularly dispersed in the final crosslinked polyamide film forming electrically inert polymer. Any suitable additional charge transporting or electrically active aryl small molecule may be employed in the charge transport layer of this invention. The expression charge transporting "small molecule" is defined herein as a monomer that allows the free charge photogenerated in the transport layer to be transported across the transport layer. This additional aryl charge transporting small molecule is incorporated into the coating mixture of this invention to increase resistance to the formation of deletion in the final electrophotographic image. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes, triphenyl methane and the like. A preferred small molecule charge transporting compound that permits injection of holes and transports them with very short transit times is N,N'-diphenyl-N,N'-bis(3-methylphenyl)-(1,1'-biphenyl)-4,4'-diamine.

Any suitable amorphous silica particle having reactive hydroxyl groups chemically attached to silicon atoms on the outer surface of the silica particles (hydrophillic materials) or treated silica particles having an organic (hydrophobic, organophillic) group may be employed. Unlike crystalline silica particles, amorphous silica particles give no sharp x-ray diffraction pattern. Typical amorphous silica particles include pyrogenic silicas and silicas precipitated from aqueous solution. The amorphous silica particles generally have a rounded or spherical shape shape. These amorphous silica particles generally have high surface areas of greater than about $3m^2$ per gram. Pyrogenic silicas can be formed at high temperature by condensation of $SiO_2$ from the vapor phase, or at lower temperature by chemical reaction in the vapor phase followed by condensation. Typical ultimate particle size of amorphous silica particles is less than about 1 micrometer in diameter. Preferably, the silica particles have a particle size less than the thickness of the overcoating layer to avoid an an excessively irregular outer surface. An average amorphous silica particle size less than about 0.5 micrometer is preferred to achieve the formation of thick overcoating layers by dip coating and to form a thick, relatively smooth outer layer surface which does not unduly abrade and prematurely shorten the life of contacting processing devices. Amorphous silica particles are commercially available such as Aerosil 200 and Aerosil 300 from Degussa, Inc. If treated amorphous particles are employed, they should free of surface material which trap charges. Materials that trap charges include, for example silica particles treated with gamma amino triethoxysilane. Charge trapping causes residual charge to build up during cycling. The amorphous silica particles should also be electrically insulating and have a bulk resistivity of at least about $10^{10}$ ohm-cm.

The thickness of the outer coatings fabricated in a single pass by the process of this invention can be surprising thick. Generally, to achieve thick layers during the dip coating process, the amorphous silica particles should be added to the coating composition to increase the viscosity of the composition. Satisfactory results are obtained with the addition of sufficient amorphous silica particles to increase the viscosity of a coating solution by at least about 20 percent measured at room temperature (25° C.). Preferably, sufficient amorphous silica particles particles should be added to increase the viscosity of a coating solution by at least about 100 percent. A typical coating solution free of amorphous silica particles is about 14 centipoises. Thus, for this example, it is preferred that sufficient amorphous silica particles are added to increase the viscosity to about 28 centipoises. Viscosity may be measured by any suitable standard technique. A typical viscosity measuring device is Physica UM Viscometer, available from Physica USA, Inc. It has been found that the addition of crystalline silica particles fail to increase the viscosity of a coating solution. The amount of amorphous silica added to achieve a desired viscosity increase depends on various factors such as the type and relative amounts of the specific dihydroxy amine charge transport material, aryl charge transport material that is different from the dihydroxy amine charge transport material, crosslinkable polyamide, crosslinking catalyst and solvents present in the coating composition selected. Also, the average particle size of the amorphous silica particles will also affect the amount needed to achieve a desired viscosity increase.

The silica particles are inert with respect to the electroactive function of the layer. Thus, for example, the particles are not charge transporting, are not electrically conductive and are not charge trapping. The outer surface of the silica particles may treated or untreated with other materials. Generally, the untreated outer surface is hydrophillic because of the presence of —OH groups attached to silicon atoms. If treated, the type of treatment utilized determines whether the outer surface of the silica particles are hydrophillic or hydrophobic. An increase in the viscosity of the coating composition of this invention can be achieved in one of two ways depending on whether the particulate silica used is hydrophilic or has been chemically surface treated to become hydrophobic. If the solvent system is essentially hydrophobic and the silica added is also hydrophobic then a stable suspension is formed with a viscosity which can approach that of heavy lubricating oil. Conversely, if the solvent system is essentially hydrophobic and the silica added is hydrophilic than a suspension is formed which, at 5 percent silica loading or above, has the form of a very viscous, elastic, gel. An essentially hydrophobic solvent system is preferred for achievement of viscosity enhancement by addition of hydrophobic silica and maintenance of dip coating medium pot-life. However, a system where the solvent system is essentially hydrophilic and the silica added is also hydrophilic can also lead to a stable moderate viscosity suspension.

One kind of surface treatment involves bi-functional chemical coupling agents. Any suitable electrically inactive bi-functional chemical coupling agent may be employed to treat the surface of the silica particles to render the outer surface thereof hydrophobic. The bi-functional chemical coupling agent comprises in a single molecule at least one reactive group which will react with hydroxyl groups on the surface of the silica particles and at least one organo functional reactive group which will render the outer surface of the silica particles compatible for homogeneous blending with the polyamide film forming binder molecules. Selection of the organo functional reactive group for the bi-functional coupling agent molecule depends on the reactive groups present on the film forming resin molecule to employed. Typical reactive groups on the bi-functional chemical coupling agent that react with reactive groups on polyamide resins include vinyl, amino, azido, amino, epoxide, halogen, sulfite, and the like. Thus, the silica particles and bi-functional coupling agent are chemically bonded to each other through an oxygen atom and the bi-functional coupling agent and film forming binder are also chemically bonded to each other. Typical reactive groups on bi-functional coupling agents which will react with the hydroxy groups on the surface of the silica particles include alkoxy, acetoxy, hydroxy, carboxy and the like. The hydrolyzable groups on the coupling agents react directly, chemically attaching themselves to the particles. More specifically, the hydrolyzable ends of the bi-functional silane coupling agents attach to the hydroxyl groups on the outer surface of the silica particles via silanol (SiOH) groups formed through hydrolysis of the hydrolyzable groups. Typical bi-functional chemical coupling agents include organosilanes having these characteristics include, for example, vinyl silanes such as vinyl triethoxy silane, triacetoxyvinyl silane, tris(2-methoxyethoxy)vinyl silane and 3-methacryloxypropyltrimethoxy silane; epoxy silanes such as [2-(3,4-epoxycyclohexylethyltrimthoxy silane; and the like and mixtures thereof.

These coupling agents are usually applied to the silica particles prior to dispersion of the silica particles into the film forming polyamide. Any suitable technique may be utilized to apply and react the coupling agent with the surface of the silica particles. The deposited coupling agent coating on the silica particles are continuous, thin, and preferably in the form of a monolayer. A preferred process for applying the bi-functional chemical coupling agent to the silica particles is by stirring the silica particles in an aqueous solution of a hydrolyzed silane. After thoroughly wetting the surface of the silica particles with the aqueous solution to ensure reaction between the reactive groups on the coupling agent molecule and the hydroxyl groups on the outer surface of the silica particles, the treated silica particles may be separated from the aqueous solution by any suitable technique such as filtering. The treated silica particles may thereafter be dried, if desired, by conventional means such as oven drying, forced air drying, combinations of vacuum and heat drying, and the like. Other techniques of silylation such as contacting the outer surface of the silica particles with vapors or spray containing the bifunctional coupling agent may also be employed. For example, sylylation may be accomplished by pouring or spraying the bi-functional chemical coupling onto the silica particles while the silica particles are agitated in a high intensity mixer at an elevated temperature. In this blending technique, the coupling agent is reacted with the hydroxyl groups directly attached to metal or metalloid atoms at the surface of the silica particles to form a reaction product in which the silica particles and the bi-functional coupling agent are Chemically bonded to each other through an oxygen atom. Such a process is described, for example, in U.S. Pat. No. 3,915,735, the disclosure of which is incorporated herein by reference in its entirety.

Generally, the concentration of the hi-functional coupling agent in the treating solution should be sufficient to provide at least a continuous mono molecular layer of coupling agent on the surface of the silica particles. Satisfactory results may be obtained with an aqueous solution containing from about 1 percent by weight to about 5 percent by weight of coupling agent based on the weight of the solution. After drying, the silica particles coated with the reaction product of the bi-functional coupling agent and hydroxyl groups attached to the metal or metalloid atoms onthe outer surface of the silica particles are dispersed in the film forming binder where further reaction occurs between the reactive organo functional groups of the bi-functional coupling agent and reactive groups on the film forming binder molecules. Dispersion may be effected by any suitable conventional mixing technique such as blending the treated silica particles with a molten thermoplastic resin or in a solution of the resin in a solvent.

Any suitable silane hi-functional chemical coupling agent may be employed which promote the formation of excellent dispersions of the silica particles in the polyamide coating mixture. These silanes are applied to the silica particles in hydrolyzed form because the OH groups of the silane will readily condense with the silanol groups on the silica particle surfaces. Typical hydrolyzable silanes are listed above.

During hydrolysis of the silanes described above, the alkoxy groups are replaced with hydroxyl groups. After drying, the reaction product layer formed from the hydrolyzed silane contains larger molecules. The reaction product of the hydrolyzed silane may be linear, partially crosslinked, a dimer, a trimer, and the like.

The hydrolyzed silane solution utilized to treat the silica particles may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 10 percent by weight of the silane based on the total weight of solution. A solution containing from about 0.1 percent by weight to about 2.5 percent by weight silane based on the total weight of solution are preferred for stable solutions which form a uniform reaction product layer on the selenium pigment or particles. The thickness of the reaction product layer is estimated to be between about 20 Angstroms and about 2,000 Angstroms.

A solution pH between about 4 and about 14 may be employed. Optimum reaction product layers on the silica particles are achieved with hydrolyzed silane solutions having a pH beween about 9 and about 13. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

If desired, the aqueous solution of a hydrolyzed silane may also contain additives such as polar solvents other than water to promote the silylation process for the silica particles. Typical polar solvents include methanol, ethanol, isopropanol, tetrahydrofuran, methoxyethanol, ethoxyethanol, ethylacetate, ethylformate and mixtures thereof. Any suitable technique may be utilized to treat the silica particles with the reaction product of the hydrolyzed silane. For example, washed silica can be swirled in a hydrolyzed silane solution for between about 1 minute and about 60 minutes and then the solids thereafter allowed to settle out and remain in contact with the hydrolyzed silane for between about 1 minute and about 60 minutes. The supernatent liquid may then be decanted and the treated silica filtered with filter paper. The silica may be dried at between about 1 minute and about 60 minutes at between about 80° C. and about 135° C. in a forced air oven for between about 1 minute and about 60 minutes. Treated silica particles are commercially available, for example, from PPG Industries.

The dip coating composition should contain at least one solvent for the polyamide, dihydroxy amine charge transport material, and the aryl charge transport material that is different from the dihydroxy amine charge transport material. Typical solvents include, for example, methanol, n-propanol, n-butanol and the like and mixtures thereof. Generally, the organic solids content of the dip coating composition of this invention is between about 1 percent and about 20 percent, based on the total weight of the solvent. A preferred solvent combination contains between about 10 and about 15 percent by weight solids, based on the total weight of the solvent. Depending upon the thickness of the coating to be deposited and the drum withdrawal rate from the coating composition, the coating composition typically has a viscosity of between about 10 centipoises and about 100 centipoises at ambient temperature. Any suitable withdrawal rate may be utilized. Typical withdrawal rates range between about 100 millimeters/minute and about 500 millimeters/minute. However viscosities and withdrawal rates outside these ranges may be employed where suitable.

The thickness of the continuous overcoat layer selected depends upon the abrasiveness of the charging (e.g., bias charging roll), cleaning (e.g., blade or web), development (e.g., brush), transfer (e.g., bias transfer roll), etc., system employed and can range up to about 10 micrometers. A thickness of between about 1 micrometer and about 5 micrometers in thickness is preferred for overcoats. For transport layers containing the polyamide coating composition of this invention, thicknesses of between about 10 micrometers and about 15 micrometers are preferred. However thicknesses outside these ranges may be employed where suitable. Any suitable and conventional technique may be utilized to mix the coating mixture components. The dip coating composition of this invention is applied to the charge generating layer or charge transport layer depending on whether the dip coated layer is a charge transport layer of an overcoating layer, respectively. The dip coating process is a conventional, well known process which generally involves the direct immersion of a substrate into the coating liquid followed by withdrawal of the substrate carrying a liquid coating layer on the outer surface thereof. This layer is dried to remove solvents from the layer. Using the compositions of this invention, thick coatings can be formed in a single dip coating pass. For example, single pass coatings that are four to five micrometers thick after drying can be formed. This thickness is substantially thicker than the 1.5 micrometer thick layers that have been formed by conventional single pass dip coating with ordinary polyamide coating compositions that do not contain the silica particles. Drying of the deposited coating may be effected by any suitable conventional technique such as oven drying, infrared radiation drying, air drying and the like. The dried overcoating of this invention should transport holes during imaging and should not have too high a free carrier concentration. Free carrier concentration in the overcoat increases the dark decay. Preferably the dark decay of the overcoated layer should be the same as that of the unovercoated device.

For thicker coatings that require multiple dip coating passes, it is preferred that each deposited coating is dried and crosslinked prior to the next dip coating pass because more uniform layer thicknesses can be achieved. However, where less uniform layer thicknesses can be tolerated, drying can be delayed until application of a subsequent coating. Also, if desired, an applied layer may be partially dried and/or the polyamide may be partially crosslinked prior to application of the next coating.

The photoreceptor of this invention may be used in any conventional electrophotographic imaging system. As described above, electrophotographic imaging usually involves depositing a uniform electrostatic charge on the photoreceptor, exposing the photoreceptor to a light image pattern to form an electrostatic latent image on the photoreceptor, developing the electrostatic latent image with electrostatically attractable marking particles to form a visible toner image, transferring the toner image to a receiving member and repeating the depositing, exposing, developing and transferring steps at least once.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

COMPARATIVE EXAMPLE I

A dip coating bath was prepared by roll milling 240.6 g. of polyamide having methylmethoxy groups pendant to the polymer backbone (Luckamide 5003, available from Dai Nippon Ink) in 4.0 litres of solvent containing 50 parts by volume methanol and 50 parts by volume N-propanol for one hour. 215.1 g. of N,N'-diphenyl-N,N'-bis(3-hydroxy phenyl)-[1,1'-biphenyl]-4,4'-diamine (a dihyroxy arylamine) was then added to the partially dissolved Luckamide solution and roll milled for an additional one hour. 24.0 g. of dihydroxy triphenyl methane was then transferred to the solution with the minimum amount (5 ml.) of methanol and the solution roll milled for a further 30 minutes. Finally, 12.1 g. of anhydrous oxalic acid (Aldrich Chemical Co.) was added and the solution roll milled for another 30 minutes. Complete dissolution of the Luckamide was ensured by addition of a minimum amount (10 ml.) of deionized water to the solution and then warming the container plus solution in a warm water bath held at 40°±1° C. for 15 to 30 minutes.

The clear coating solution was then used to fill a one gallon capacity, stainless steel dip coating tank equipped with an overflow weir and a coating bath recirculation system driven by a compressed air motor pump. After establishment of stable bath recirculation free of entrained air bubbles, a 30 mm outside diameter, 250 mm long, bilayer-type, electrophotographic photoreceptor having an outer charge transport layer containing 40 weight percent N,N'-diphenyl-N,N'-bis(3-methylphenyl)-1,1'-biphenyl-4,4'-diamine, 60 weight percent polycarbohate resin (Makrolon 5705, available from Farbensabricken Bayer A. G.), based on the total weight of the charge transport layer, was dip coated in this coating bath using an insertion rate of 250 mm/min., a dwell time of 3 seconds and a withdrawal rate of 250 mm/min. After 5 minutes for solvent flash-off at ambient temperature the overcoated photoreceptor was transferred to a forced air oven held at 125° C. for 30 minutes and then to a laminar flow hood for cool down to room temperature.

COMPARATIVE EXAMPLE II

A 30 mm outside diameter, 250 mm long, uncoated, rough-lathed, aluminum pipe of the type used as the substrate for the photoreceptor of Comparative Example I was dip coated in the same coating solution using the same equipment, coating parameters and drying conditions as described for Comparative Example I. The uncoated pipe was used in the present comparative example to enable more accurate measurement of the thickness of the deposited coating. The dip coated overcoating thickness on this bare aluminum substrate was then measured at several positions along the length of the substrate using an Otsuka gauge. The across-drum dip coated film thickness profile was constant across-drum at 2.1 micrometers.

COMPARATIVE EXAMPLE III

A 30 mm outside diameter, 250 mm long, uncoated, rough-lathed, aluminum pipe identical to that used in Comparative Example II was dip coated in the same coating solution using the same equipment, coating parameters and drying conditions as described for Comparative Examples I and II. After cooling to room temperature the aluminum pipe (now carrying a crosslinked, single pass dip coating of the overcoat) was remounted in the dip coating apparatus and a second dip coating conducted using the same coating solution, equipment, coating parameters and drying conditions as described for the first dip coating pass except that the aluminum pipe was dip coated over only part of its length in the second pass. The across-drum thickness profile of the dip coated layer in both the single pass dip coated region and the double pass dip coated region was measured with an Otsuka gauge. The across-drum dip coated film thickness profile for the single-pass dip coated coated region was constant across-drum at 2.1 micrometers (as found also in Comparative example II) and the dip coated film thickness established at equilibrium pull rate for the double-pass coated region was constant across-drum at 4.2 micrometers. This Comparative Example III confirms that, when the coated layer is cross-linked by heating between dip coatings, repeating the dip coating step results in a final dry coating thickness which is twice the dry thickness achieved in a single pass and which exhibits excellent across-drum uniformity.

COMPARATIVE EXAMPLE IV

A 30 mm outside diameter, 250 mm long, uncoated, rough-lathed, aluminum pipe identical to that used in Comparative Examples II and III was dip coated in the same coating solution using the same equipment and coating parameters as described for Comparative Examples I and II. Following the first pass dip coating and 5 minute solvent flash-off in air ambient the alumnum pipe (now carrying a non-cross-linked, single-pass dip coating) was subjected to a second dip coating pass in the same solution under the same conditions as described for the first dip coating pass except that, in the second pass, the aluminum pipe was coated over only part of its length. Following the second pass dip coating and 5 minute solvent flash-off in air ambient the coated layers were cross-linked by oven drying the coated pipe for 30 minutes at 125° C. as described in Comparative Example I.

The across-drum thickness profile of the dip coated layer in both the single pass dip coated region and the double pass dip coated region was measured with an Otsuka gauge. The across-drum dip coated film thickness profile shows that the dip coated film thickness established at equilibrium pull rate for the single-pass coated region was constant across-drum at about 2.1 micrometers (as found also in Comparative Example II) but that the equilibrium pull rate dip coated film thickness established for the double-pass coated region decreased across-drum from a maximum of more than 5 micrometers near the beginning of the second dip coating pass to less than about 5 micrometers at the end of the coating. This Comparative Example IV confirms that, when the coated layer is not cross-linked by heating between dip coatings, repeating the dip coating step results in a final dry coating thickness which initially maximizes at about twice the dry thickness achieved in a single pass but which decreases measurably across-drum thereafter.

EXAMPLE V

A dip coating bath is prepared using the materials, amounts and procedures as described in Comparative Example I. The coating solution so prepared has a viscosity at room temperature of about 14 centipoise and a solids concentration of about 13 percent by weight. A quantity of finely divided, amorphous, silica is added to the solution sufficient to increase the room temperature viscosity of the coating solution from about 14 centipoise to about 28 centipoise. A 30 mm outside diameter, 250 mm long, rough-lathed aluminum pipe identical to that used in Comparative Examples II, III and IV is dip coated using the coating bath (now with viscosity increased from 14 centipoise to 28 centipoise by addition of finely divided, amorphous silica) using the same equipment, coating parameters and drying conditions as described in Comparative Examples I and II. The single-pass dip coated film thickness measured with an Otsuka gauge after oven drying is expected to be increased from the 2.1 micrometers measured for single pass dip coatings of Comparative Examples II, III and IV to about 3.3 micrometers.

EXAMPLE VI

A dip coating bath is prepared using the materials, amounts and procedures as described in Comparative Example I. The coating solution so prepared has a viscosity at room temperature of about 14 centipoise and a solids concentration of about 13 percent by weight. A quantity of finely divided, amorphous, silica is added to the solution sufficient to increase the room temperature viscosity of the coating solution from about 14 centipoise to about 140 centipoise. A 30 mm outside diameter, 250 mm long, rough-lathed aluminum pipe identical to that used in Comparative Examples II, III, IV and V is dip coated using the coating bath (now with viscosity increased from 14 centipoise to 140 centipoise by addition of finely divided, amorphous silica) using the same equipment, coating parameters and drying conditions as described in Comparative Examples I and II. The single-pass dip coated film thickness measured with an Otsuka gauge after oven drying is expected to be increased from the 2.1 micrometers measured for single pass dip coatings of Comparative Examples II, III and IV to about 9.7 micrometers.

Although the invention has been described with reference to specific preferred embodiments, it is not intended to be limited thereto, rather those having ordinary skill in the art will recognize that variations and outside modifications may be made therein which are within the spirit of the invention and within the scope of the claims.

What is claimed is:

1. A process for fabricating an electrophotographic imaging member comprising providing a substrate coated with at least one photoconductive layer, applying a coating composition to said photoconductive layer by dip coating to form a wet layer, said coating composition comprising finely divided amorphous silica particles, a dihydroxy amine charge transport material, an aryl charge transport material that is different from said dihydroxy amine charge transport material, a crosslinkable polyamide containing methoxy groups attached to amide nitrogen atoms and a crosslinking catalyst, at least one solvent for said hydroxy amine charge transport material, aryl charge transport material that is different from said dihydroxy amine charge transport material and said crosslinkable polyamide, and heating said wet layer to crosslink said polyamide and remove said solvent to form a dry layer in which said dihydroxy amine charge transport material and said aryl charge transport material are molecularly dispersed in a crosslinked polyamide matrix.

2. A process according to claim 1 wherein said polyamide is selected from the group consisting of materials represented by the following formulae I and II:

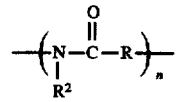

I wherein:

n is a positive integer,

R is independently selected from the group consisting of alkylene, arylene or alkarylene units, between 1 and 99 percent of the $R^2$ sites are —H, and the remainder of the $R^2$ sites are $—CH_2—O—CH_3$ and

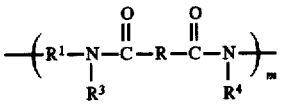

II wherein:

m is a positive integer, $R_1$ and R are independently selected from the group consisting of alkylene, arylene or alkarylene units, between 1 and 99 percent ofthe $R^3$ and $R^4$ sites are —H, and the remainder of the $R^3$ and $R^4$ sites are $—CH_2—O—CH_3$.

3. A process according to claim 1 wherein said dihydroxy amine is represented by the formula:

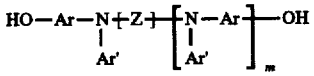

wherein:

m is 0 or 1,

Z is selected from the group consisting of:

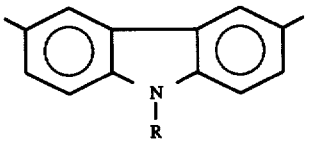

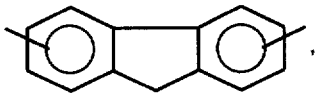

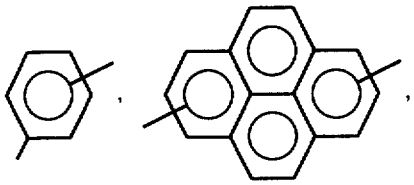

and

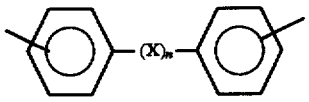

n is 0 or 1,

Ar is selected from the group consisting of:

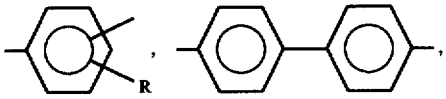

and

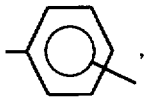

R is selected from the group consisting of $—CH_3$, $—C_2H_5$, $—C_3H_7$, and $—C_4H_9$, Ar' is selected from the group consisting of:

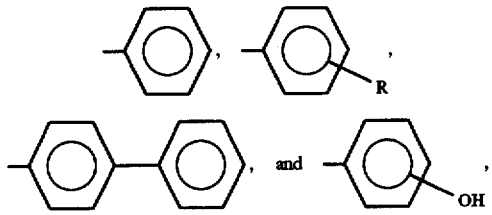

X is selected from the group consisting of:

$-CH_2-$, $-C(CH_3)_2-$, $-O-$, $-S-$,

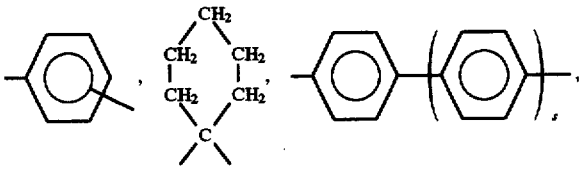

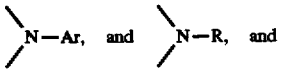

s is 0, 1 or 2.

4. A process according to claim 1 wherein said dry layer is a continuous overcoating layer having a thickness less than about 10 micrometers.

5. A process according to claim 1 wherein said silica particles have a hydrophobic outer surface.

6. A process according to claim 5 wherein said at least one solvent is hydrophobic.

7. A process according to claim 1 wherein said silica particles have a hydrophillic outer surface.

8. A process according to claim 7 wherein said at least one solvent is a mixture of methanol and n-propanol.

9. A process according to claim 1 wherein said coating composition has a viscosity of between about 14 centipoises and about 28 centipoises.

10. A process according to claim 1 wherein said dry layer is a charge transport layer.

11. A process according to claim 10 wherein said charge transport layer has a thickness after drying between about 10 micrometers and about 15 micrometers.

12. A process according to claim 1 wherein said at least one photoconductive layer comprises a charge generating layer and a charge transport layer.

13. A process according to claim 12 wherein said dry layer is an overcoating layer overlying said charge transport layer.

14. A process according to claim 1 wherein said dry layer is substantially insoluble in any solvent in which it was soluble prior to crosslinking.

15. A process according to claim 1 including forming a second coating of said coating composition on said wet layer prior to said heating.

16. A process according to claim 1 including forming a second coating of said coating composition on said dry layer and heating said second coating to crosslink said polyamide and remove said solvent to form a second dry layer in which said dihydroxy amine charge transport material and said aryl charge transport material are molecularly dispersed in a crosslinked polyamide matrix.

* * * * *